United States Patent [19]

Oshima et al.

[11] 4,230,423

[45] Oct. 28, 1980

[54] ICE-BREAKING APPARATUS FOR STRUCTURE FOR USE IN ICY WATERS

[75] Inventors: Masanao Oshima; Mikihisa Komoto; Shoichi Yabuki; Tsuneo Inokawa, all of Tokyo, Japan

[73] Assignee: Mitsui Engineering & Shipbuilding Co., Ltd., Tokyo, Japan

[21] Appl. No.: 854,104

[22] Filed: Nov. 23, 1977

[30] Foreign Application Priority Data

Nov. 24, 1976 [JP] Japan ..... 51-140222

[51] Int. Cl.[2] ..... E02B 17/00; B63B 35/12

[52] U.S. Cl. ..... 405/211; 114/42

[58] Field of Search ..... 61/102, 103, 1 R; 405/61, 211, 217; 114/40, 41, 42

[56] References Cited

U.S. PATENT DOCUMENTS

| | | | |
|---|---|---|---|
| 3,667,416 | 6/1972 | Fioravanti et al. | 114/42 |
| 3,669,052 | 6/1972 | Schirtzinger | 61/102 X |
| 3,759,046 | 9/1973 | Anders | 61/102 |
| 3,807,179 | 4/1974 | Stone | 405/61 |
| 4,048,943 | 9/1977 | Gerwick | 405/211 |

FOREIGN PATENT DOCUMENTS

| | | | |
|---|---|---|---|
| 54124 | 1/1938 | Denmark | 114/42 |

*Primary Examiner*—David H. Corbin

*Attorney, Agent, or Firm*—Armstrong, Nikaido, Marmelstein & Kubovcik

[57] ABSTRACT

A rotary ice-breaking body having a spiral rotary blade is attached to a structure for use in icy waters at a part falling in contact with an ice lump or ice floe. The rotary blade is actuated to bite into the ice lump and to lift up or press down the ice lump. The ice lump is broken by the flexural stress and the structure is protected from influences of the ice lump. One rotary ice-breaking body may be disposed to constitute the outer periphery of the structure. Alternately, a plurality of rotary ice-breaking bodies may be disposed to surround the structure so that they are driven and rotated simultaneously or independently.

2 Claims, 14 Drawing Figures

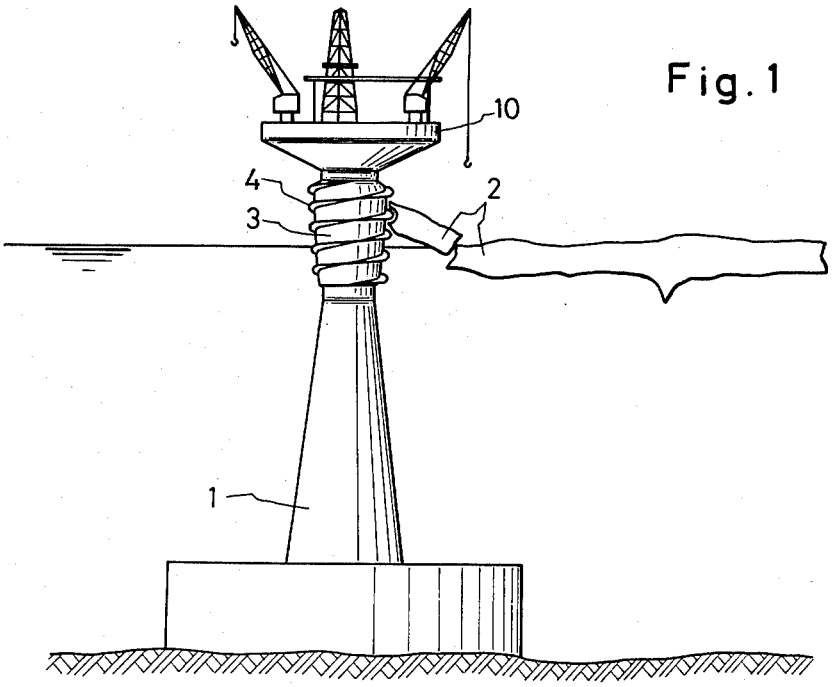
Fig. 1
PRIOR ART Fig. 7 (a)
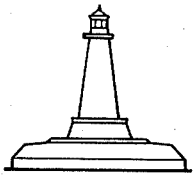
PRIOR ART Fig. 7 (b)
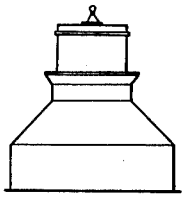
PRIOR ART Fig. 7 (c)
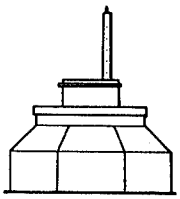
PRIOR ART Fig. 7 (d)
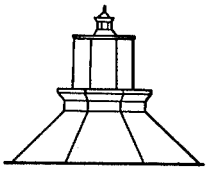
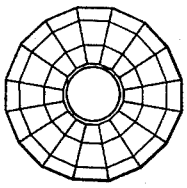
Fig. 7 (e) PRIOR ART
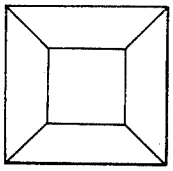
Fig. 7 (f) PRIOR ART
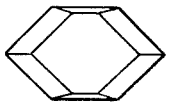
Fig. 7 (g) PRIOR ART
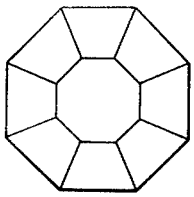
Fig. 7 (h) PRIOR ART

ICE-BREAKING APPARATUS FOR STRUCTURE FOR USE IN ICY WATERS

BACKGROUND OF THE INVENTION

The present invention relates to an ice-breaking apparatus for a structure for use in icy waters.

With recent increase of demand for energy sources and because of uneven distribution of petroleum resources and rise in prices of petroleum products, the importance of exploitation of submarine oil resources has been increasing, and even icy water regions are now objects of this exploitation. The exploitation of submarine oil resources involves a serious problem; how to protect an oil-drilling structure, for example, an oil-drilling platform, from external forces of floating ice lumps or floes surging upon the structure.

In order to cope with this problem, the configuration or framework of the structure has heretofore been especially arranged or designed as shown in FIGS. 7-(*a*) to 7-(*h*) of the accompanying drawing, but in many cases, no sufficient ice-breaking capacity can be obtained. Therefore, the operation region or time is often restricted.

The present invention is to overcome this defect involved in the conventional techniques. It is therefore a primary object of the present invention to provide an ice-breaking apparatus in which ice lumps are positively broken to reduce external forces imposed on an oil-drilling structure without adopting negative means of improving the ice-resisting capacity by changing the configuration of the structure.

Another object of the present invention is to provide an ice-breaking apparatus in which ice lumps are broken mainly by utilizing the flexural load.

Still another object of the present invention is to provide an ice-breaking apparatus which can be operated any time and anywhere with restrictions on the operation time and region being completely removed.

BRIEF SUMMARY OF THE INVENTION

The present invention is based on the principle that ice is relatively inferior in the strength or resistance against the flexural load and the ice-breaking operation is performed in the present invention by utilizing this special physical property of ice. More specifically, according to the present invention, a rotary ice-breaking body having a spiral rotary blade is attached to a structure at a part falling in contact with an ice lump, and the rotary blade is driven by driving means in the state where it is biting into the ice lump, whereby the ice lump is lifted up or pressed down and is broken by a flexural stress caused in the ice lump by this lifting-up or pressing-down. Accordingly, since the ice-breaking mode is not a compression breaking mode, the energy necessary to break the ice lump is relatively small. Further, broken ice pieces are discharged sideway of the structure with rotation of the rotary blade, and the structure is not damaged at all by broken ice pieces.

The above-mentioned and other objects and features of the present invention will be apparent from the following detailed description made by reference to the accompanying drawing.

BRIEF DESCRIPTION OF THE DRAWING

FIG. 1 is a front view illustrating one embodiment of the ice-breaking apparatus of the present invention;

FIGS. 7-(*a*) to 7-(*h*) are diagrams illustrating conventional techniques, in which FIGS. 7-(*a*) to 7-(*d*) are front views and FIGS. 7-(*e*) to 7-(*h*) are corresponding plan views.

DETAILED DESCRIPTION OF THE PREFERRED EMBODIMENTS

Figure 2:
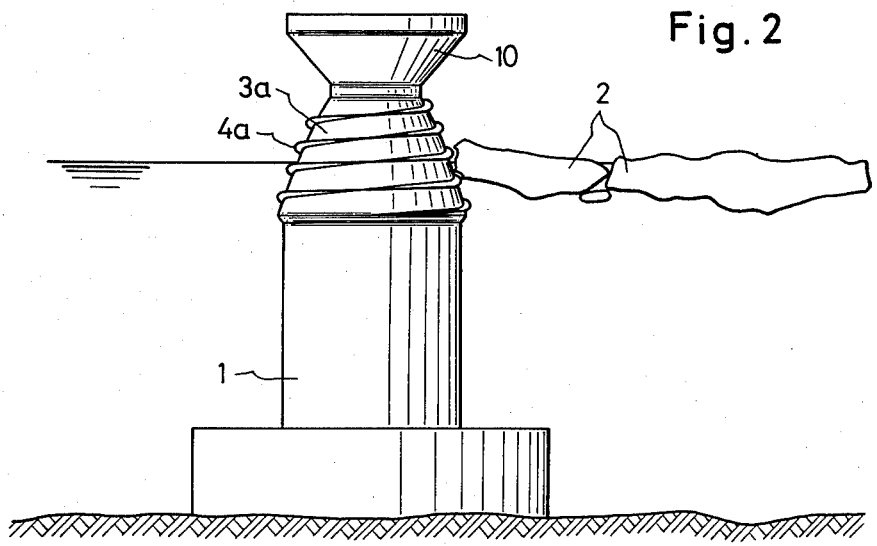
FIG. 2 is a front view illustrating another embodiment of the ice-breaking apparatus of the present invention.

In the first embodiment illustrated in FIG. 1, the ice-breaking apparatus of the present invention is applied to an oil-drilling platform. Referring to FIG. 1, a rotary ice-breaking body 3 is disposed in the upper portion of a column 1 of the oil-drilling platform in the vicinity of a position falling in contact with an ice lump or ice floe 2 floating on the water face, and a spiral rotary blade 4 having an upwardly expanded, reverse-frustoconical shape is mounted on the periphery of the ice-breaking body 3.

In the present embodiment, when the rotary blade 4 is rotated in a clockwise direction seen from above in the state where the rotary blade 4 bites in the ice lump 2, since the rotary blade 4 is spirally arranged, the ice lump 2 is gradually lifted up. Since the rotary blade 4 has a reverse-frustoconical shape as described above, biting of the rotary blade 4 into the ice lump 2 is assuredly maintained, and the portion of the ice lump 2 closer to the column 1 is lifted up more highly than the portion farther from the column 1. Accordingly, the weight of the ice lump per se and the surging force of ice are added, and a high flexural stress is produced in the ice lump 2 and it is broken into relatively large plate-like pieces as shown in the drawing. The so formed ice pieces are pushed away sideway of the column 1 by rotation of the rotary blade 4 and the column 1 is not damaged by these ice pieces at all.

Figure 3:
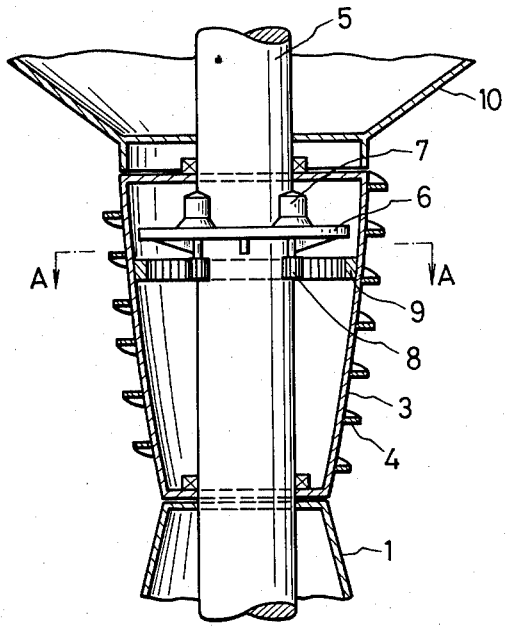
FIG. 3 is a sectional side view illustrating a driving mechanism for a rotary ice-breaking body to be used for the embodiments shown in FIGS. 1 and 2.
Figure 4:
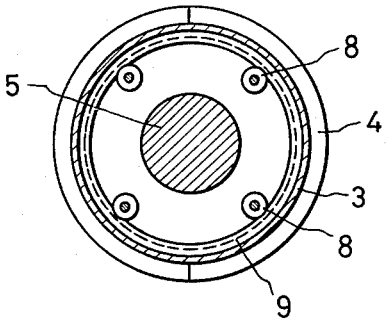
FIG. 4 is a view showing the section taken along the line A—A in FIG. 3.

FIG. 3 is a side view illustrating an example of the driving means for a rotary ice-breaking body 3 in FIG. 1 and a rotary ice-breaking body 3*a* in FIG. 2, and FIG. 4 is a view showing the section taken along the line A—A in FIG. 3. Referring to FIGS. 3 and 4, a supporting stand 6 is mounted on a columnar portion 5, and a plurality of direct current electric motors 7 are disposed on this supporting stand 6 to drive inner gears 9 on the inside of the rotary ice-breaking body 3 through small gears 8. In the present embodiment, the rotary ice-breaking body 3 is disposed between the platform 10 and the column 1 and the driving electric motors are mounted in the interior of the rotary ice-breaking member 3. The embodiment may be modified so that the driving mechanism is disposed on the platform 10 or in the column 1 to drive the rotary ice-breaking body 3 through an appropriate power transmission mechanism such as gears and chains.

In the second embodiment shown in FIG. 2, the ice-breaking apparatus of the present invention is applied to an oil-drilling platform. Also in this embodiment, a rotary ice-breaking body 3*a* is mounted on a column 1 at a part falling in contact with an ice lump floating on the water face, but a spiral rotary blade 4*a* mounted on the periphery of the ice-breaking body 3*a* has a downwardly expanded frustoconical shape reverse to the shape of the rotary blade 4 shown in FIG. 1. In this case, the rotary blade 4*a* is caused to bite in the ice lump 2 by the surging force of ice, and when the rotary blade 4*a* is slowly rotated in this state, the ice lump 2 is gradually lifted up or pressed down. The portion of the ice lump 2 closer to the rotary blade 4*a* is lifted up more highly or pressed down more lowly than the portion farther from the rotary blade 4*a*. Accordingly, the flexural load is produced in the ice lump 2 and the surging force is added thereto, and the ice lump 2 is broken into plate-like pieces in the position relatively close to the column 1 as shown in the drawing.

Figure 5:
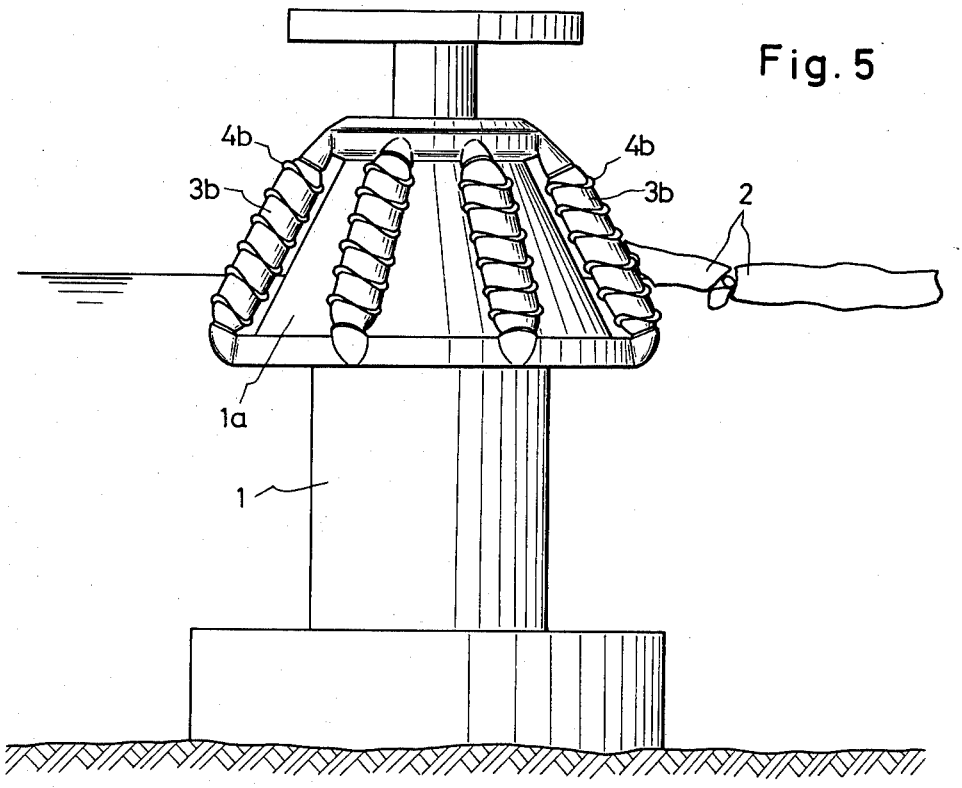
FIG. 5 is a front view illustrating still another embodiment of the ice-breaking apparatus of the present invention.

In the third embodiment shown in FIG. 5, the ice-breaking apparatus of the present invention is applied to an oil-drilling platform. In this embodiment, a plurality of rotary ice-breaking bodies 3*b* are disposed along the periphery of of a conical portion 1*a* of a column 1 of the platform in the vicinity of the water face, and a spirally rotary blade 4*b* is mounted on the periphery of each ice-breaking body 3*b*. In this embodiment, if only an ice-breaking body 3*b* facing a floating ice lump 2 is actuated, the ice lump 2 is broken by the rotary blade 4*b* mounted on said ice-breaking body 3*b*. Accordingly, the energy required for ice-breaking is diminished to a minimum and this embodiment is advantageous from the economical viewpoint.

Figure 6:
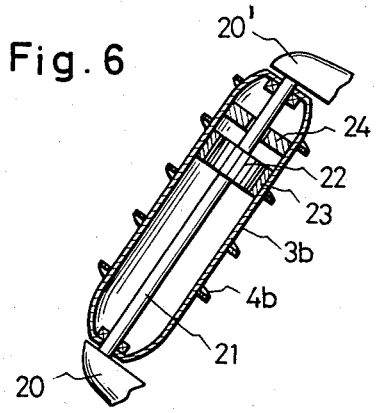
FIG. 6 is a sectional side view illustrating a driving mechanism for a rotary ice-breaking body to be used for the embodiment shown in FIG. 5.

FIG. 6 is a sectional side view illustrating an example of the driving mechanism for the rotary ice-breaking body shown in FIG. 5. Referring to FIG. 6, a shaft 21 is fixed to arms 20 and 20' extended from a column 1, and a fixing member 22 is fixed to the shaft 21 and a rotor 23 fixed on the inner face of the rotary ice-breaking body 3*b* is disposed on the periphery of the shaft 21 to face the fixing member 22. A rectifier 24 is disposed to apply an electric current to the rotor 23 so that the rotary ice-breaking body 3*b* is rotated with rotation of the rotor 23.

In a modification of the embodiment illustrated in FIG. 6, bearings are disposed in the arms 20 and 20' to support rotatably the shaft 21, and the rotary ice-breaking body 3*b* is fixed to the shaft 21 and the shaft 21 is driven through a power transmission mechanism such as gears and chains.

The ice-breaking apparatus of the present invention can be applied to not only a monopod type fixed structure as shown in the foregoing embodiments but also tripodal or tetrapod multi-column structures. In the case where the ice-breaking apparatus of the present invention is applied to such multi-column structure, especially good results are attained if the directions of the rotary blades and rotation directions thereof are arranged in the respective columns so that ice pieces formed by one rotary blade are prevented from impinging against other columns.

As will be apparent from the foregoing illustration, according to the present invention, since ice lumps are positively broken by utilizing the flextural load, the energy required for breaking ice lumps can be remarkably saved and the external force imposed to the structure can be remarkably diminished. Therefore, the resistance of the structure against surging ice lumps can be highly improved, and restrictions on the application time and region of the structure can be greatly moderated.

Further, according to the present invention, since broken ice pieces can be discharged sideways as soon as ice lumps are broken, the broken ice pieces form ridges and a risk that destructive forces of these broken ice pieces are imposed on the structure can be completely expelled.

Still further, if a plurality of rotary ice-breaking bodies having a spiral rotary blade on the periphery are disposed on the periphery of the structure, an intended ice-breaking effect can be attained if only a rotary ice-breaking body located at the ice-breaking-required position is driven, and therefore, the ice-breaking energy can be remarkably saved.

As is apparent to those skilled in the art, the ice-breaking apparatus of the present invention may be arranged so that the rotary body is rotated in a direction pushing down an ice lump into water on the contrary to the ice-breaking manner in the foregoing embodiments.

What is claimed is:

1. An ice-breaking apparatus for a structure used in water containing ice floes, said apparatus comprising:

a central mounting means having a downwardly expanding frustoconical shape mounted on said structure at the level of the ice floes;

a plurality of body means each said body means having a generally cylindrical shape with the axial centerlines of said plurality of body means forming a downwardly expanding frustoconical shape in outline, each said body means rotatably mounted on and spaced around the periphery of said central mounting means; and a spiral blade means mounted on a peripheral edge of each said body means;

wherein as said body means are rotated and the ice floes contact at least one spiral blade means, said spiral blade means is driven into an edge portion of the ice floe and either raises or lowers the ice floe to subject the ice floe to a bending force for causing the ice floe to break into relatively large plate-like pieces which are pushed sideways of said body means by virtue of said body means rotary action to effectively prevent damage to said central mounting means by the ice floe.

2. An ice breaking apparatus as claimed in claim 1, wherein said rotary spiral blade means each include both upwardly and downwardly facing ice bending portions.

* * * * *